United States Patent [19]

Worcester et al.

[11] Patent Number: 4,849,013

[45] Date of Patent: Jul. 18, 1989

[54] COMBINED ELECTRON BEAM AND VACUUM ARC MELTING FOR BARRIER TUBE SHELL MATERIAL

[75] Inventors: Samuel A. Worcester; Charles R. Woods, both of Ogden, Utah

[73] Assignee: Westinghouse Electric Corp., Pittsburgh, Pa.

[21] Appl. No.: 80,151

[22] Filed: Jul. 30, 1987

Related U.S. Application Data

[63] Continuation of Ser. No. 871,183, Jun. 5, 1986, abandoned.

[51] Int. Cl.[4] ..... C22B 4/00; C21C 5/52

[52] U.S. Cl. ..... 75/10.26; 75/10.1; 75/10.28; 75/65 EB; 75/84.5

[58] Field of Search ..... 75/65 EB, 10.26, 10.28, 75/10.1, 84.5

[56] References Cited

U.S. PATENT DOCUMENTS

| | | | |
|---|---|---|---|
| 2,707,679 | 5/1955 | Lilliendahl | 75/84 |
| 2,773,023 | 12/1956 | Raynes | 204/140 |
| 2,866,700 | 12/1958 | Bohnet | 75/10 |
| 2,935,395 | 5/1960 | Smith | 75/10 |
| 2,942,098 | 6/1960 | Smith | 219/121 |
| 2,960,331 | 11/1960 | Hanks | 266/34 |
| 2,963,530 | 12/1960 | Hanks | 13/31 |
| 2,986,503 | 5/1961 | Pruvot | 204/64 |
| 2,997,760 | 8/1961 | Hanks | 22/200.1 |
| 3,068,309 | 12/1962 | Hanks | 13/31 |
| 3,087,211 | 4/1963 | Howe | 22/57.2 |
| 3,091,525 | 5/1963 | D'A Hunt | 75/84 |
| 3,131,051 | 4/1964 | Hanks | 75/10 |
| 3,219,435 | 11/1965 | Gruber | 75/10 |
| 3,226,223 | 12/1965 | Bussard | 75/10 |
| 3,342,250 | 9/1967 | Treppschuk | 75/10 R |
| 3,615,345 | 10/1971 | King | 75/10 |
| 3,764,297 | 10/1973 | Coad | 75/10 R |
| 4,108,644 | 8/1978 | Walberg | 75/135 |
| 4,130,416 | 12/1978 | Zaboronok | 75/10 R |
| 4,190,404 | 2/1980 | Drs | 425/8 |
| 4,372,817 | 2/1983 | Armijo | 376/417 |
| 4,482,376 | 11/1984 | Tarasecu | 75/10 R |

FOREIGN PATENT DOCUMENTS

| | | |
|---|---|---|
| 67788 | 6/1981 | Japan . |

*Primary Examiner*—Peter D. Rosenberg
*Attorney, Agent, or Firm*—R. A. Stoltz

[57] ABSTRACT

This is a process for making a very pure and very homogeneous material for use in lining the interior of zirconium alloy fuel element cladding. The improvement utilizes the forming of a consumable electrode from generally virgin sponge material, melting the consumable electrode in a multiple swept beam electron beam furnace with a feed rate between 1 and 20 inches per hour and then vacuum arc melting the EB melted material.

13 Claims, No Drawings

COMBINED ELECTRON BEAM AND VACUUM ARC MELTING FOR BARRIER TUBE SHELL MATERIAL

This application is a continuation of application Ser. No. 06/871,183 filed June 5, 1986, abandoned.

CROSS REFERENCE TO RELATED APPLICATIONS

A related process is described in copending application Ser. No. 871,182 assigned to the same assignee. Although that related application also produces very pure material for the same uses, and also uses an electron beam melting step, it, in addition, uses a vacuum baking step prior to EB melting, with that vacuum baking step being performed for at least one half hour at a temperature controlled to between 250° and 400° C. That related application is hereby incorporated by reference.

A process and product is described in copending related application Serial No. 780,343 assigned to the same assignee. The process of the instant invention is an alternate process to that described in the copending application and the product of the process described herein may fall within the ranges of composition described in that copending application and that copending application is hereby incorporated by reference herein.

BACKGROUND OF THE INVENTION

1. Field of the Invention

This is a metal purification process for zirconium.

This invention relates to high purity zirconium and in particular to electron beam melting followed by vacuum arc melting.

2. Description of the Related Art

The conventional process for making zirconium metal utilizes a fluidized bed process in which the ore is subjected to a chlorination step which produces a relatively impure, hafnium-containing zirconium tetrachloride (which by-product is relatively easily separated). The hafnium and zirconium containing material is then subjected to a number of purifying operations and also a complex hafnium separation operation. These operations result in purified oxides of zirconium and hafnium, which, of course, are maintained separate. The purified oxides are separately chlorinated. Zirconium and hafnium are commonly reduced from the chloride by means of a reducing metal, typically magnesium. At the present time, the commercial processes are batched-type processes. U.S. Pat. No. 3,966,460, for example, describes a process of introducing zirconium tetrachloride vapor onto molten magnesium, with the zirconium being reduced and traveling down through the magnesium layer to the bottom of the reactor and forming a metallic sponge The metallic sponge (containing remaining chloride and some remaining excess reducing metal) is then placed in a distillation vessel for removal of the remaining salt and reducing metal by high temperature vacuum distillation. The sponge material is generally crushed, screened and pressed into electrodes for vacuum arc melting. Particularly, the material is multiple (typical double or triple) vacuum arc melted to provide ingots which are then further fabricated into various shapes. Most of the zirconium currently is used to produce Zircaloy.

Commercial nuclear reactors generally have used Zircaloy tubes as cladding material to contain the uranium dioxide fuel. Generally a Zircaloy ingot is processed into a so-called "trex" and pilgering operations are used to reduce the trex inside diameter and wall thickness to size. Ultrapure zirconium has been proposed for a liner for the inside surface of Zircaloy tubing which is used as a cladding for nuclear fuel and is described in, for example, U.S. Pat. No. 4,372,817 to Armijo et al. on Feb. 8, 1983. A similar use of moderate purtiy material is proposed in U.S. Pat. No. 4,200,492 to Armijo et al. on Apr.29, 1980. The ultrapure zirconium material described has been purified by iodide cells to produce so called "crystal bar" material. This rather expensive crystal bar processing is performed after reduction and is described, for example, in U.S. Pat. No. 4,368,072 issued to Siddal on Jan. 11, 1983.

EB (electron beam) melting of materials, including zirconium has been discussed in a number of patents EB melting has been used to consolidate crushed particles or chips in so called hearth furnaces and to separate impurities by either overflowing floating inclusions (U.S. Pat. No. 4,190,404 to Drs et al. on Feb. 26, 1980) or to produce an electrode for arc melting (U.S. Pat. No. 4,108,644 to Walberg et al. on Aug. 22, 1978). A number of U.S. Patents have used EB melting of powders or granules, often producing an ingot in a chilled mold. These powder melting EB patents include U.S. Pat. Nos. 2,942,098 to Smith on June 21, 1960; 2,960,331 to Hanks on Nov. 15, 1960; 2,963,530 to Hanks et al. on Dec. 6, 1960; 2,997,760 to Hanks et al. on Aug. 29, 1961; 2,935,395 to Smith on May 3, 1960; and 4,482,376 to Tarasescu et al. on Nov. 13, 1984. Electron beam zone refining using multiple passes is described in U.S. Pat. No. 3,615,345 to King on Oct. 26, 1971.

EB melting using a consumable feed "electrode" to produce an ingot collected in a chilled mold has also been discussed in a number of patents, including U.S. Pat. Nos. 3,087,211 to Howe on Apr. 30, 1963; 3,226,223, to Bussard et al. on Dec. 28, 1965; 2,880,483 to Hanks et al. on Apr. 7, 1959; and 4,130,416 to Zaboronok et al. on Dec. 19, 1978. U.S. Pat. No. 3,219,435 to Gruber et al. on Nov. 23, 1965 shows a commercial type EB furnace utilizing multiple beams. Typically the beams are directed to the surface of the molten pool and are continually swept across the pool surface to avoid overheating of any single portion of the pool surface. U.S. Pat. No. 3,091,525 to D'A. Hunt of May 28, 1983 described adding a small amount of zirconium, for example, to hafnium, for example and melting in an EB furnace to deoxidize the hafnium. Japanese application No. 1979-144789, published as patent report No. 1981-67788 by Kawakita describes the use of a very small ingot with a high power density and ultra slow melting to produce a deep molten pool to produce a high purity ingot directly usable for lining of Zircaloy tubing for nuclear reactor applications. Such laboratory sized apparatus with its high powered consumption and very low throughput is, of course, not practical for commercial production.

SUMMARY OF THE INVENTION

This is a process for making very pure and very homogeneous material for use in the lining of the interior of zirconium alloy fuel element cladding Generally this process provides material much purer than the so called sponge material and almost as pure as the crystal bar material, at a fraction of the cost of crystal bar material.

Generally the material of this process has oxygen in the 250–450 ppm range (and preferably less than about 350) and iron in the 50–300 ppm range. Total impurities are generally in the 500–1000 ppm range (total impurities for these purposes generally comprise the elements listed in the aforementioned U.S. Pat. No. 4,200,492).

This process is an improvement on the process wherein zirconium tetrachloride is reduced to produce a metallic zirconium sponge, the sponge is distilled to generally remove residual magnesium and magnesium chloride salt and the distilled sponge is melted to produce a final ingot. The improvement comprises forming the distilled sponge into a consumable electrode, melting the consumable electrode in a production (i.e., multiple swept beam) electron beam furnace with a feed rate of between 1 and 20 inches per hour and collecting the melted material to form an intermediate ingot. The intermediate ingot is then vacuum arc melted to produce a final ingot. The product of this process is inexpensive, homogeneous, yet low in both oxygen and iron.

Preferably the energy input via the electron beams is maintained to a moderate level such that the molten pool on the upper portion of the intermediate ingot has a depth of less than about one fourth of the ingot diameter, thus lowering power costs. Preferably an argon sweep is provided in the electron beam furnace during melting. Multiple passes may be made both through the EB furnace and the vacuum arc furnace.

DESCRIPTION OF THE PREFERRED EMBODIMENTS

This invention provides a process for producing low iron and oxygen impurity level zirconium in which the impurities are homogeneously distributed.

The distilled zirconium sponge is formed into a consumable electrode for use in a production EB furnace. A production furnace is generally shown in the aforementioned U.S. Pat. No. 3,219,435, but with the multiple beams being constantly swept across the surface of the molten pool (as defined herein, a production EB furnace has an output "intermediate" ingot having a diameter greater than five inches, and generally greater than six inches. Generally, this consumable electrode for EB melting is formed by pressing crushed virgin sponge (not recycle scrap). The compact and an appropriate end fitting are welded to form the consumable electrode.

The consumable EB electrode is melted in a production electron beam furnace with a feed rate between 1 and 20 inches per hour. It has been found that small amounts of residual magnesium chloride remain in the electrode and absorb some moisture. Melting at faster than 20 inches per hour results in this moisture reacting to oxidized zirconium and thus. causing an unacceptably high oxygen level in the product. Conversely too slow a melting rate, while possibly removing some oxygen from the molten pool (as described in the aforementioned Japanese patent publication No. 1981-67788) is uneconomical. It should be noted that significant oxygen removal from the molten pool takes considerable superheating of the molten pool and much slower melting rates and thus this invention provides for no significant oxygen removal from the molten pool. It has also been found that the iron impurity level is generally reduced by about a factor of two, each pass through the EB furnace (that is, when the intermediate ingot formed during the first EB melting pass is used as the consumable electrode for a second EB melting, the iron level is reduced by another factor of approximately 2). It has also been found that the level of other common impurities, for example aluminum and chromium, are also reduced by each pass through the EB furnace. It should also be noted that, as the residual magnesium chloride is generally removed during the first EB melting, there is minimal absorbed moisture on the second pass and thus somewhat faster speeds may be used after the first EB pass.

Generally an argon sweep is provided in the electron beam furnace during melting. It is felt that this helps remove moisture which has been vaporized off the electron from the furnace, minimizing contamination of the output intermediate ingot. Preferably the argon sweep is at a flow of 10,000–1,000,000 liters per second, with the liters measured at a pressure of $10^{-5}$ Torr (rather than at standard conditions). The argon sweep can be established, for example, with pumps capable of handling 60,000 liters per second and with a pressure of $10^{-5}$ Torr measured with to raise the pressure to approximately $10^{-4}$ Torr.

It should be noted that the sponge used to form the consumable electrode is generally virgin material (as opposed to recycled scrap or turnings) and preferably is selected high quality material and generally selected for low oxygen content.

Generally, after EB melting, the material is arc melted (and preferably double arc melted or even triple arc melted) to homogenize the impurity distribution. It has been found that in production EB furnaces, with their relatively shallow molten pool (the molten pool being shallow both in comparison to arc melting, where the molten pool is typically about twice the ingot diameter and in comparison to non-multiple swept beam, laboratory type furnaces where the fixed single beam covers essentially the entire surface of the molten pool and produces molten pools of about one diameter in depth) do not produce a homogeneous product. The zirconium material beneath the molten pool is, of course, solid, and can be slowly withdrawn as material from the electrode drips into the pool, as it is known in the prior art.

Thus, on a production EB furnace, the shallow molten pool results in a non-homogeneous product, and only by following such melting with vacuum arc melting can a homogeneous product be obtained. Conversely, non-swept beam EB furnaces having very high power costs for very low throughput, are impractical for commercial applications. This invention lowers oxygen by removing at least some of the moisture prior to melting while the laboratory type of EB furnace is generally removing oxygen from the molten pool.

Thus, the product of this process is homogeneous, has low total impurities, including low oxygen (but generally not quite as low as the oxygen in the copending application Ser. No. 871.182, and low iron (the iron level being generally controlled by the number of passes through the EB furnace). The process is relatively inexpensive and, being compatible with existing production processes, requires little capital investment, as compared to, for example, the aforementioned copending U.S. application Ser. No. 780,343.

The invention is not to be construed as limited to the particular examples described herein, as these are to be regarded as illustrative, rather than restrictive. The invention is intended to cover all processes which do not depart from the spirit and scope of the invention.

We claim:

1. In combination with a process of the type wherein zirconium tetrachloride is reduced to produce a metallic zirconium sponge, the sponge is distilled to generally remove residual magnesium and magnesium chloride, and the distilled sponge is melted to produce an ingot, the improvement for making a non-crystal bar material for use in lining the interior of zirconium alloy fuel element cladding which comprises:

a. forming said distilled sponge into a consumable electrode;

b. melting said consumable electrode in a multiple swept beam electron furnace with a feed rate between 1 and 20 inches per hour to form an intermediate ingot; and c. vacuum arc melting said intermediate ingot to produce a homogeneous final ingot, having 50–500 ppm iron.

2. The process of claim 1, wherein said intermediate ingot has a molten pool on its upper portion, with said molten pool having a depth of less than about one fourth of an ingot diameter.

3. The process. of claim 1, wherein an argon sweep is provided in said electron beam furnace during said melting.

4. The process of claim 3, wherein said argon sweep is at a flow of 10,000–1,000,000 liters per second, measured at a pressure $10^{-5}$ Torr 5. The process of claim 1, wherein multiple passes are made through said electron beam furnace.

6. The process of claim 4, wherein multiple passes are made through said electron beam furnace.

7. The process of claim 6, wherein multiple passes are made through said vacuum arc melting 8. The process of claim 5, wherein multiple passes are made through said vacuum arc melting.

9. The process of claim 1, wherein virgin sponge material is utilized.

10. The process of claim 1, wherein said intermediate ingot has a diameter of greater than 5 inches.

11. In combination with a process of the type wherein zirconium tetrachloride is reduced to produce a metallic zirconium sponge, the sponge is distilled to generally remove residual magnesium and magnesium chlorie, and the distilled sponge zirconium is melted to produce an ingot, the improvement for making a non-crystal bar material for use in lining the interior of zirconium alloy fuel element cladding which comprises:

a. forming said distilled sponge zirconium into a consumable electrode;

b. melting said consumable electrode in a multiple swept beam electron-beam furnace with a feed rate between 1 and 20 inches per hour to form an electron-beam melted zirconium ingot; and c. vacuum arc melting said electron-beam melted zirconium ingot to produce a homogeneous final ingot having 50–300 ppm iron and 500–1000 ppm of total impurity.

12. The process of claim 2, wherein said final ingot has 250–450 ppm of oxygen and 500–1000 ppm of total impurities.

13. A homogeneous lining for the interior of a zirconium alloy fuel element cladding made according to an improved process, said process being of the type wherein zirconium tetrachloride is reduced to produce a metallic zirconium sponge, the sponge is distilled to generally remove residual magnesium and magnesiium chloride, and the distilled sponge is melted to produce an ingot, the improvement for making a non-crystal bar material for use in lining the interior of zirconium alloy fuel element cladding comprising:

a. forming said distilling sponge into a consumable electrode;

b. melting said consumable electrode in a multiple swept beam electron furnace with a feed rate between 1 and 20 inches per hour to form an intermediate ingot, wherein said intermediate ingot has a molten pool on its upper portion, with said molten pool having a depth of less than about one fourth of an ingot diameter; and c. vacuum arc melting said intermediate ingot to produce a homogeneous final ingot, having 50–300 ppm iron, 250–450 ppm of oxygen, and 500–1000 ppm of total impurites.

* * * * *